US007258091B2

(12) United States Patent
Abe

(10) Patent No.: US 7,258,091 B2
(45) Date of Patent: Aug. 21, 2007

(54) ROCKER ARM

(75) Inventor: Katsufumi Abe, Iwata (JP)

(73) Assignee: NTN Corporation, Osaka (JP)

( * ) Notice: Subject to any disclaimer, the term of this patent is extended or adjusted under 35 U.S.C. 154(b) by 0 days.

(21) Appl. No.: 11/322,359

(22) Filed: Jan. 3, 2006

(65) Prior Publication Data

US 2006/0107916 A1 May 25, 2006

Related U.S. Application Data

(62) Division of application No. 10/649,675, filed on Aug. 28, 2003, now Pat. No. 7,011,061.

(30) Foreign Application Priority Data

Sep. 9, 2002 (JP) ..... 2002-262259

(51) Int. Cl.
*F01L 1/18* (2006.01)

(52) U.S. Cl. ..... 123/90.39; 123/90.44; 29/888.2; 74/559

(58) Field of Classification Search ..... 123/90.39, 123/90.43, 90.44, 90.16, 90.2; 29/888.2; 74/559, 567, 569
See application file for complete search history.

(56) References Cited

U.S. PATENT DOCUMENTS 5,678,459 A 10/1997 Motohashi et al.

(Continued)

FOREIGN PATENT DOCUMENTS

JP 10-299429 11/1998

(Continued)

OTHER PUBLICATIONS

U.S. Appl. No. 10/649,575, filed Aug. 28, 2003, Katsufumi Abe.

(Continued)

*Primary Examiner*—Ching Chang

(57) ABSTRACT

There is provided a rocker arm of a kind in which even though the rocker arm is manufactured by the use of a press working technique the arm width can be minimized while the flat outer surface region of a required width is secured on an outer surface of the connecting wall, thereby contributing to reduction in size and weight of the rocker arm. This rocker arm is capable of being driven by a cam for selectively opening and closing a valve of an internal combustion engine. This rocker arm includes an arm body prepared by bending a single plate material to represent a generally inverted U-shaped section including opposite side walls and a connecting wall bridging between the opposite side walls. A roller engageable with the cam is rotatably mounted on a portion of the arm body generally intermediate of the length thereof. A valve drive element is mounted on one end of the arm body for driving the valve, while an end portion of the connecting wall adjacent the other end of the arm body is formed with an internally helically threaded hole for threadingly receiving therein an externally helically threaded pivot member. An outer chamfered corner delimited between an outer surface of the connecting wall and an outer surface of each of the opposite side walls and formed by bending is deformed to represent a plastically deformed portion so formed by means of a plastic deformation technique that the outer chamfered corner represents a small radius of curvature R.

2 Claims, 6 Drawing Sheets

U.S. PATENT DOCUMENTS

| | | | | |
|---|---|---|---|---|
| 5,720,245 | A | 2/1998 | Calka | |
| 6,041,747 | A | 3/2000 | Kotani et al. | |
| 6,199,527 | B1 | 3/2001 | Okubo et al. | |
| 7,011,061 | B2 * | 3/2006 | Abe | 123/90.41 |

FOREIGN PATENT DOCUMENTS

| | | |
|---|---|---|
| JP | 11-270312 | 10/1999 |
| JP | 2001-041011 | 2/2001 |
| JP | 2001-059407 | 3/2001 |
| JP | 2001-065313 | 3/2001 |
| JP | 2001-317311 | 11/2001 |
| JP | 2002-147207 | 5/2002 |
| JP | 2002-195011 | 7/2002 |

OTHER PUBLICATIONS

Japanese Patent 10-299429 corresponds to U.S. Patent 6,401,747.
Japanese Office Action for Application No. 2002-262259; dated Aug. 1, 2006.

* cited by examiner

ROCKER ARM

CROSS-REFERENCE TO RELATED APPLICATIONS

This application is a Division of U.S. application Ser. No. 10/649,675, filed Aug. 28, 2003, issued as U.S. Patent No. 7,011,061, which claims the benefit of Japanese Patent Application No. 2002-262259, filed on Sep. 9, 2002, in the Japanese Intellectual Property Office, the disclosures of which are incorporated herein in their entirety by reference.

BACKGROUND OF THE INVENTION

1. Field of the Invention

The present invention relates to a rocker arm of a type adapted to be driven by a cam for selectively opening and closing a valve mounted on a cylinder head of the combustion engine.

2. Description of the Related Art

Inexpensive and lightweight rocker arms of this kind are currently manufactured by the use of, for example, a precision casting technique and a press working technique. Of those rocker arms, the rocker arms manufactured by the use of the press working technique to have a generally U-shaped section taken along the line perpendicular to the longitudinal sense thereof have now gained the mainstream in the market. The press-worked rocker arm has a screw-locked-pivot type and a contact-pivot type. The screw-locked-pivot type is illustrated in FIGS. 12A and 12B and is of a design in which a pivot area of a generally elongated arm body 34 is formed with an internally helically threaded hole 42 and a generally elongated pivot member 37 having an externally helically threaded screw shank 37*a* is threadingly inserted into the threaded hole 42 and is locked in position by means of a lock nut 43 mounted externally on the screw shank 37*a*. On the other hand, the contact-pivot type which will be described later with reference to FIGS. 10 and 11 is of a design in which a pivot area of a generally elongated arm body is formed with a generally semispherical recess for pivotally receiving therein a correspondingly semispherically shaped abutment end of a pivot projection mounted rigidly on the cylinder head.

In any one of the screw-locked-pivot type and the contact-pivot type, since the pivot area referred to above is an area on which a load is imposed, the diameter of the threaded hole 42 and the size of the abutment end of the pivot projection are determined after strength calculation has been performed. As such, FIG. 13 illustrates the rocker arm of the screw-locked-pivot type in which a connecting wall 36 of the arm body 34 bridging between opposite side walls 35 depending from such connecting wall 36 is chosen to have a wall thickness greater than other portions of the arm body 34 to secure a sufficient strength in the pivot area.

Also, the pivot area of the arm body in any one of the screw-locked-pivot type and the contact-pivot type is defined in a flat outer surface region of the connecting wall 36 bridging between the opposite side walls 35 as best shown in FIG. 12B. In the rocker arm manufactured by the use of the press working technique, an outer surface region (hereinafter referred to as an "outer chamfered corner") delimited between an outer surface of the connecting wall 36 and an outer surface of each of the opposite side walls 35 is generally rounded to represent a certain radius of curvature R shown in FIG. 12A, which radius of curvature R has hitherto been chosen equal to or greater than the wall thickness. By way of example, even though an inner surface region delimited between an inner surface of the connecting wall 36 and an inner surface of each of the opposite side walls 35 is at right angles relative to each other (hence, the radius of curvature being zero), the radius of curvature R of the outer surface region, that is, the outer chamfered corner is generally chosen to be equal to or greater than 3 mm if the wall thickness is 3 mm.

In view of the foregoing, where in the rocker arm manufactured by the use of the press working technique the pivot area is defined in the connecting wall 36 as hereinabove described, the rocker arm must have a width sufficient to secure the required flat outer surface region in the connecting wall 36 and the required radius of curvature R of the outer chamfered corner. More specifically, in the rocker arm of the screw-locked-pivot type such as shown in FIGS. 12A and 12B, the lock nut 43 firmly threaded onto the screw shank 37*a* of the pivot member 37 should not loosen under the influence of vibrations due to an automotive vehicle then running and an automotive power plant then in operation and, accordingly, the flat outer surface region of the connecting wall 36 must have a width L2 that is necessarily less than the maximum outer diameter of the lock nut 43. While in the rocker arm manufactured by the use of the precision casting technique it is quite easy to reduce the radius of curvature R of the outer chamfered corner, delimited between the connecting wall 36 and each of the opposite side walls 35, down to a relatively small value, it is not so with the rocker arm manufactured by the use of the press working technique. Specifically, where the required flat outer surface region is to be secured on the connecting wall of the rocker arm manufactured by means of the press working technique, the arm width tends to increase as compared with that in the rocker arm manufactured by means of the precision casting technique, with the consequence that reduction in size and weight of the rocker arm manufactured by means of the press working technique is limited as compared with that manufactured by means of the precision casting technique.

SUMMARY OF THE INVENTION

The present invention is accordingly devised to substantially eliminate the problems and inconveniences inherent in the prior art rocker arms and is intended to provide an improved rocker arm of a kind in which even though the rocker arm is manufactured by the use of a press working technique the arm width can be minimized while the flat outer surface region of a required width is secured on an outer surface of the connecting wall, thereby contributing to reduction in size and weight of the rocker arm.

In order to accomplish the foregoing object, the present invention in one aspect thereof is applied to a rocker arm of the end pivot type, which is capable of being driven by a cam for selectively opening and closing a valve mounted on a cylinder head of a combustion engine as the rocker arm undergoes a rocking motion about a point of pivot defined in one end thereof. This rocker arm of the end pivot type includes a generally elongated arm body having first and second ends opposite to each other and prepared by bending a single plate material to represent a generally inverted U-shaped section including opposite side walls and a connecting wall bridging between the opposite side walls. A cam follower roller is rotatably mounted on a portion of the arm body generally intermediate between the first and second ends thereof for engagement with the cam. A valve drive element is mounted on the first end of the arm body for driving the valve, and an end portion of the connecting wall adjacent the second end of the arm body is formed with an internally helically threaded hole for threadingly receiving therein an externally helically threaded pivot member. In this rocker arm of the end pivot type, an outer chamfered corner delimited between an outer surface of the connecting wall and an outer surface of each of the opposite side walls and formed by bending is deformed to represent a plastically deformed portion so formed by means of a plastic deformation technique that the outer chamfered corner represents a small radius of curvature.

The presence of the outer chamfered corner having the uniquely designed radius of curvature, that is represented by the plastically deformed portion does effectively allow the flat outer surface region of the connecting wall, where the internally helically threaded hole is defined, to have a width that can be increased without increasing the width of the arm body itself. Because of this, it is possible to provide the rocker arm that is compact in structure and lightweight while the strength required in pivot area is sufficiently secured in the flat outer surface region of the connecting wall and, yet, the width of the arm body is relatively small.

Although when the rocker arm of the structure discussed above is in use under a loaded condition, an external force may act on the arm body, tending to widen the opposite side walls in a lateral direction away from each other. However, with the outer chamfer corners formed by the plastic deformation technique to represent the small radius of curvature as discussed above, the opposite side walls can advantageously resist strongly the force tending to widen them in a lateral direction away from each other, thereby minimizing a possible deformation of the rocker arm as a whole. It is to be noted that since the small radius of curvature of the outer chamfered corner is accomplished by the use of the plastic deformation technique, this can be performed in a short time as compared with any known mechanical working. Thus, this additional plastic deforming step taken after the press working step of producing the arm body of a generally inverted U-sectioned configuration would not result in an undue reduction in productivity.

Also, the present invention in another aspect thereof is applied to a rocker arm of the center pivot type, which is capable of being driven by a cam for selectively opening and closing a valve mounted on a cylinder head of a combustion engine as the rocker arm undergoes a rocking motion about a point of pivot defined in a portion of the rocker arm generally intermediate of the length thereof. This rocker arm of the center pivot type includes a generally elongated arm body having first and second ends opposite to each other and prepared by bending a single plate material to represent a generally inverted U-shaped section including opposite side walls and a connecting wall bridging between the opposite side walls. A pivot fulcrum is defined in a portion of the arm body generally intermediate of the length thereof, and the arm body undergoes a rocking motion about such pivot fulcrum. A cam follower roller is rotatably mounted on the first end of the arm body for engagement with the cam, and the second end of the arm body is formed with an internally helically threaded hole for threadingly receiving therein an externally helically threaded valve drive member. Even in this rocker arm of the center pivot type, an outer chamfered corner delimited between an outer surface of the connecting wall and an outer surface of each of the opposite side walls and formed by bending is deformed to represent a plastically deformed portion so formed by means of a plastic deformation technique that the outer chamfered corner represents a small radius of curvature.

Even the rocker arm of the center pivot type so constructed as hereinabove described can bring about effects and advantages similar to those afforded by the rocker arm of the end pivot type described above. Specifically, the presence of the outer chamfered corner having the uniquely designed radius of curvature that is represented by the plastically deformed portion does effectively allow the flat outer surface region of the connecting wall, where the internally helically threaded hole is defined, to have a width that can be increased without increasing the width of the arm body itself. Because of this, it is possible to provide the rocker arm that is compact in structure and lightweight while the strength required in the screw mount area is sufficiently secured in the flat outer surface region of the connecting wall and, yet, the width of the arm body is relatively small.

Yet, the present invention in accordance with a further aspect thereof is applied to a rocker arm of the end pivot type and concurrently of the contact-pivot type, which is capable of being driven by a cam for selectively opening and closing a valve mounted on a cylinder head of a combustion engine as the rocker arm undergoes a rocking motion about a point of pivot defined in one end thereof. This rocker arm includes a generally elongated arm body having first and second ends opposite to each other and prepared by bending a single plate material to represent a generally U-shaped section including opposite side walls and a connecting wall bridging between the opposite side walls. A cam follower roller is rotatably mounted on a portion of the arm body generally intermediate between the first and second ends thereof for engagement with the cam. A valve drive element is mounted on the first end of the arm body for driving the valve, and an end portion of the connecting wall adjacent the second end of the arm body is formed with a pivot abutment area to which a free end of a pivot support member is engaged. In a manner similar to any one of the foregoing rocker arms of the different type, an outer chamfered corner delimited between an outer surface of the connecting wall and an outer surface of each of the opposite side walls and formed by bending is deformed to represent a plastically deformed portion so formed by means of a plastic deformation technique that the outer chamfered corner represents a small radius of curvature.

Even the rocker arm of the end pivot type and concurrently of the contact-pivot type so constructed as hereinabove described can bring about effects and advantages similar to those afforded by the previously described rocker arms of the different type described above. Specifically, the presence of the outer chamfered corner having the uniquely designed radius of curvature that is represented by the plastically deformed portion does effectively allow the flat outer surface region of the connecting wall to have a width that can be increased without increasing the width of the arm body itself. Because of this, it is possible to provide the rocker arm that is compact in structure and lightweight while the strength required in the pivot abutment area is sufficiently secured in the flat outer surface region of the connecting wall and, yet, the width of the arm body is relatively small.

In any one of the rocker arms according to the different aspects of the present invention, the radius of curvature of the outer chamfered corner delimited between the outer surface of the connecting wall and the outer surface of each of the opposite side walls is preferably smaller than a wall thickness of the arm body and, more preferably, smaller than 70% of the wall thickness of the arm body.

If the radius of curvature of the outer chamfered corner is equal to or larger than the wall thickness of the arm body, a relatively large width of the flat outer surface area cannot be effectively secured on the connecting wall. If the radius of curvature of the outer chamfered corner that is smaller than 70% of the wall thickness of the arm body is employed, effects and advantages resulting from increase in width of the flat outer surface area of the connecting wall can be appreciated.

Particularly in any one of the rocker arms according to the first and second mentioned aspects of the present invention, respective portions of inner surfaces of the opposite side walls adjacent the internally helically threaded hole may be formed with corresponding helical threads. The helical threads in those portions of the inner surfaces of the opposite side walls occupy respective parts of a cylindrical extension of the internally helically threaded hole for threadingly receiving the externally helically threaded pivot member or the valve drive member.

It is to be noted that since the arm body prepared from the plate material by the use of the press working technique has such a relatively small wall thickness as to allow it to be manufactured lightweight, a sufficient depth can hardly be obtained in the internally helically threaded hole for threadingly receiving the externally helically threaded pivot member or valve drive member. However, the presence of the helical threads in the respective portions of the inner surfaces of the opposite side walls is effective to allow the externally helically threaded pivot member or valve drive member to be threadingly engaged not only in the internally helically threaded hole, but also with the helical threads in the opposite side walls, thus allowing those portions of the inner surfaces of the opposite side walls to be utilized for supporting the externally helically threaded pivot member or valve drive member. Because of this, not only can a sufficient threading strength be obtained, but the width of the arm body can also be further reduced, thereby facilitating the arm body to be manufactured compact in size and lightweight.

Also, in any one of the rocker arms according to the first and second mentioned aspects of the present invention, an outer flat surface area of the connecting wall delimited between the plastically deformed portions, which is adjacent the internally helically threaded hole, may have a width about equal to an maximum outer diameter of a lock nut that is fastened to the externally helically threaded pivot member or valve drive member then threadingly engaged in the internally helically threaded hole in the connecting wall. If the width of the outer flat surface area of the connecting wall is about equal to the maximum outer diameter of the lock nut, the lock nut can advantageously be fastened firmly and, also, the width of the arm body as a whole can be minimized to the extent required, thereby allowing the rocker arm to be manufactured compact in structure and lightweight.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE PREFERRED EMBODIMENTS

Figure 1:
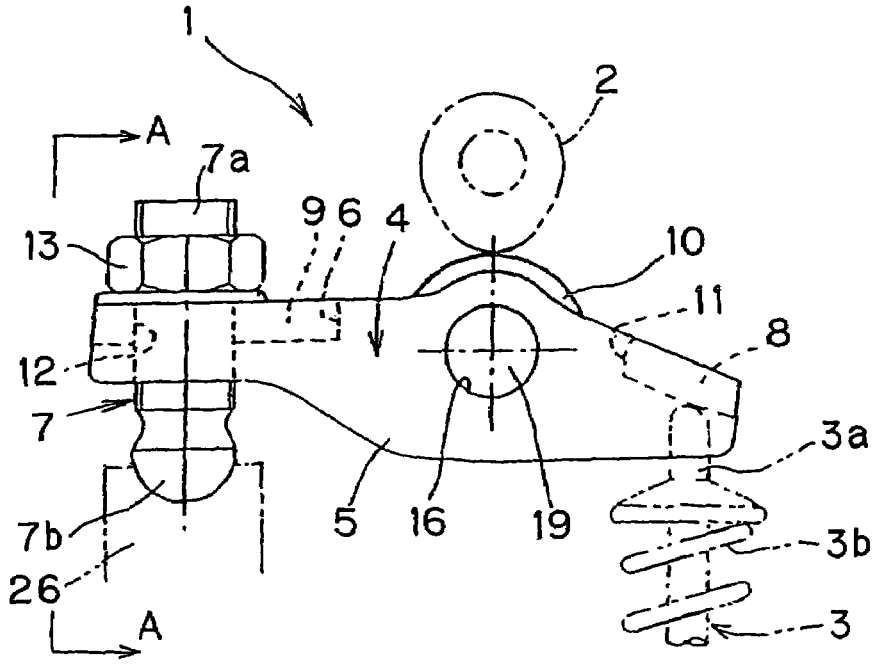
FIG. 1 is a side view of a rocker arm according to a first preferred embodiment of the present invention.

The first preferred embodiment of the present invention will first be described with particular reference to FIGS. 1 to 4B. A rocker arm 1 is of a type mounted on an internal combustion engine and adapted to be driven by a cam 2 so as to undergo a rocking motion for selectively opening and closing a valve body (not shown) on a cylinder head of the combustion engine. This valve body is rigid or integral with a lower end of a valve stem 3*a*. This valve stem 3*a* forms a part of an elongated valve member 3 that is movably mounted on the engine cylinder head. The illustrated rocker arm 1 is of an end pivot type, in which the rocker arm 1 is rockingly supported at one end thereof by means of a pivot seat 26 and is prepared from a plate metal by the use of any known press working technique. This rocker arm 1 includes a generally elongated arm body 4 having one end on which an adjustment screw 7, which serves as an elongated pivot member as will become clear from the subsequent description, is threadingly mounted. The adjustment screw 7 includes an externally helically threaded screw shank 7*a* provided at one end thereof with a pivot element 7*b* that is movably supported by the pivot seat 26. The pivot element 7*b* integral or fast with the screw shank 7*a* is of a substantially semispherical shape and the pivot seat 26 has a correspondingly semispherical recess defined therein for pivotally receiving the pivot element 7*b* therein.

The other end of the arm body 4 remote from the adjustment screw 7 is provided with a valve drive area 8 engageable with an upper end of the valve stem 3*a*. The valve stem 3*a* is movable up and down, but is normally biased upwardly, as viewed in FIG. 1, by a compression spring 3*b*. It is to be noted that one end of the valve stem 3*a* remote from the valve drive element 8 is provided rigidly or integrally with the valve body (not shown) for selectively opening and closing a valve port defined in the engine cylinder head as the rocker arm 1 is rocked by an overhead cam 2. A cam follower roller 10 cooperable with this overhead cam 2 is rotatably supported at a portion of the arm body 4 generally intermediate of the length thereof.

The arm body 4 prepared from a steel plate by the use of any known press working technique is made up of opposite side walls 5 and a connecting wall 6 bridging between the opposite side walls 5. When the rocker arm 1 is in use, the connecting wall 6 assumes an upper position with respect to the engine cylinder head and is positioned on one side opposite to the valve member 3. In other words, the arm body 1 so constructed represents a generally inverted U-shaped section over the substantially entire length of the rocker arm 1.

The illustrated arm body 4 has a side profile which is substantially straight, but which may be angled. The connecting wall 6 extends over the substantially entire length of the rocker arm 1 but has its intermediate portion depleted to define a roller window 11 from which the roller 10 is partially exposed for rolling contact with the cam 2. One end portion of the connecting wall 6 adjacent the valve member 3 defines the valve drive area 8 engageable with the upper end of the valve stem 3*a* while the opposite end portion thereof defines a screw mount area 9 for receiving the adjustment screw 7.

The end portion of the connecting wall 6 where the screw mount area 9 is defined has an internally helically threaded hole 12 defined therein, and the adjustment screw 7 is adjustably supported by the screw mount area 9 with the screw shank 7*a* threadingly engaged in the internally helically threaded hole 12. With the adjustment screw 7 so supported by the screw mount area 9 in the connecting wall 6, an upper end portion of the screw shank 7*a* opposite to the pivot member 7*b* protrudes outwardly upwardly beyond the level of the screw mount area 9. The adjustment screw 7 so mounted on the screw mount area 9 is firmly retained in position by means of a lock nut 13 fastened to that upper end portion of the screw shank 7*a* until it is brought into tight contact with the screw mount area 9.

The cam follower roller 10 shown in FIG. 1 is rotatably mounted on a support axle 19 that is rigidly supported at its opposite ends by the opposite side walls 5 so as to extend therebetween. Specifically, the support axle 19 has its opposite ends firmly received in corresponding bearing holes 16 defined in the opposite side walls 5.

Figure 3A:
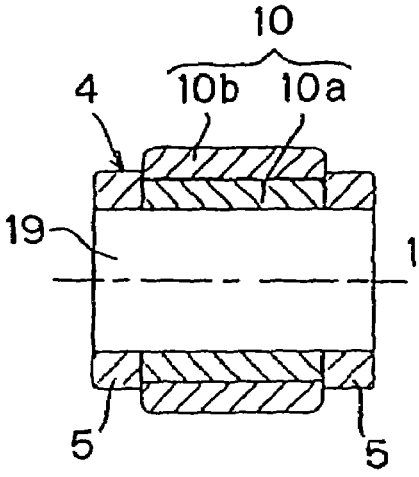
FIGS. 3A to 3C are transverse sectional view showing different structures of a roller carried by the arm body, respectively.

As best shown in FIG. 3A, the roller 10 may be of a double roller structure made up of an inner roller element 10*a* and an outer roller element 10*b*. The inner roller element 10*a* is rotatably mounted on the support axle 19, with a slidable bearing interface defined consequently between an inner peripheral surface of the inner roller element 10*a* and an outer peripheral surface of the support axle 19, and the outer roller element 10*b* is rotatably mounted on the inner roller element 10*a* with another slidable bearing interface defined consequently between an inner peripheral surface of the outer roller element 10*b* and an outer peripheral surface of the inner roller element 10*a*.

Figure 3B:
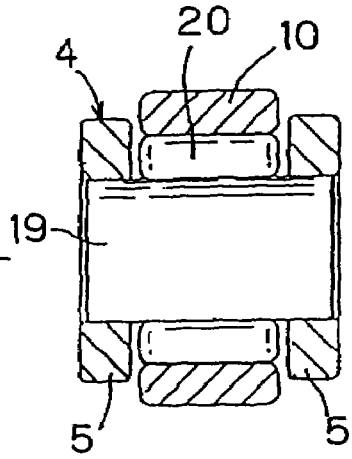

Alternatively, as shown in FIG. 3B, the roller 10 may be employed in the form of an outer race of a rolling bearing which includes, in addition to the outer race, a multiplicity of rolling elements 20 such as needle rollers. As shown therein, the roller 10 may be rotatably mounted on the support axle 19 with the rolling elements 20 interposed between it and the support axle 19.

Figure 3C:
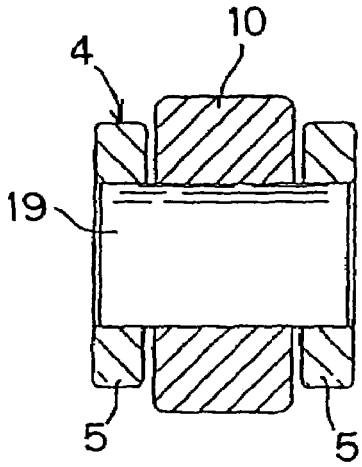

While the roller 10 shown in FIG. 3A may be referred to as a double roller type and the roller 10 shown in FIG. 3B may be referred to as a rolling bearing type, the roller 10 may be of a single roller type made up of a single roller integer as shown in FIG. 3C where a slide contact is desired.

Figure 2A:
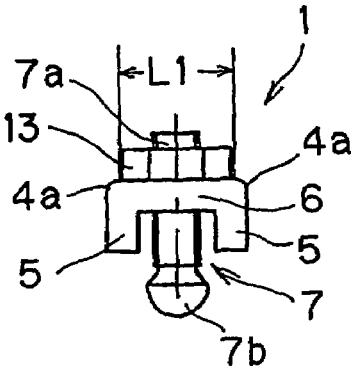
FIG. 2A is an end view of the rocker arm shown in FIG. 1 as viewed in a direction shown by the arrows in FIG. 1.
Figure 2B:
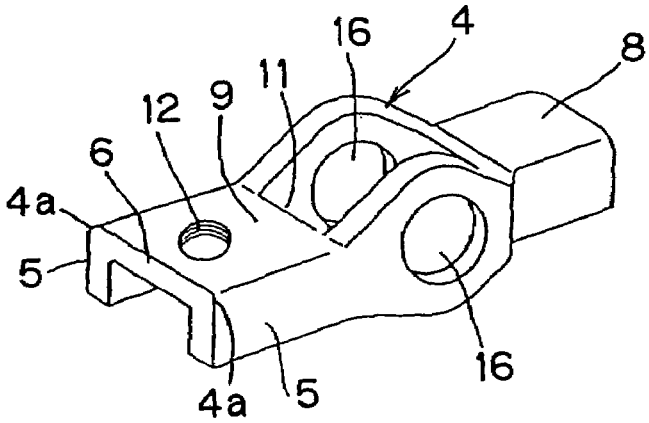
FIG. 2B is a perspective view of an arm body of the rocker arm shown in FIG. 1.

The arm body 4 shown in and described with reference to FIGS. 1 and 2 is preferably made of a steel material such as a case hardened steel (for example, SCM 415), of a kind tempered after having been carburized. The effective case depth of the steel material hardened by the carburizing treatment is preferably within the range of 0.4 to 1.5 mm and, more preferably, within the range of 0.4 to 0.9 mm.

Figure 4A:
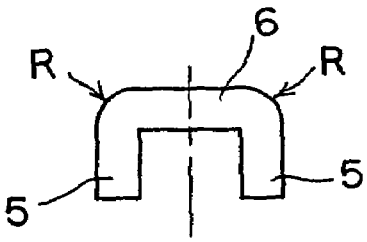
FIGS. 4A and 4B are schematic diagrams showing sequential manners of forming the arm body, respectively, that is employed in the rocker arm of FIG. 1.
Figure 4B:
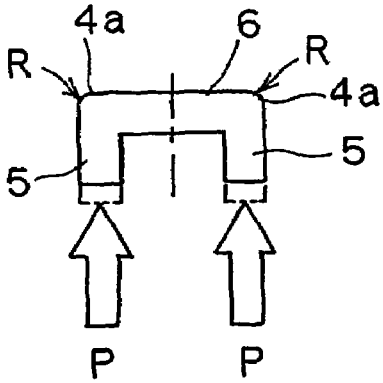

The arm body 4 has a pair of opposite outer side corners extending generally parallel to each other in a direction lengthwise of the arm body 4. As shown in FIG. 4B, each of outer side corners 4*a* delimited between an outer surface of the connecting wall 6 and an outer surface of the respective side wall 5 formed by bending is deformed to represent a plastically deformed portion which is so formed by means of a plastic deformation technique that the respective outer chamfered corner, as defined hereinbefore, can represent a small radius of curvature R as shown in FIG. 4A.

The plastic deformation referred to above may be accomplished by any suitable press work such as a squeezing process, but a so-called planer press work may be employed therefor. By way of example, after the opposite side walls 5 have been bent in the same direction so as to depend transversely from the connecting wall 6 as shown in FIG. 4A, the small radius of curvature R can be achieved in the outer chamfered corner 4*a* by applying a pressure P to end faces of the opposite side walls 5 remote from the connecting wall 6 so as to allow the side walls 5 to be compressed in a direction parallel to wall faces of the side wall 5 as shown in FIG. 4B. In accordance with this embodiment, the radius of curvature R of each of the outer chamfered corners 4*a* is chosen to be smaller than the wall thickness of the plate material used to form the arm body 4. More specifically, the radius of curvature of each outer chamfered corner 4*a* is chosen to be equal to or smaller than 70% of the wall thickness of the arm body 4.

With the rocker arm 1 the presence of the plastically deformed portion, that is, the outer chamfered corner 4*a* having the uniquely designed radius of curvature R does effectively allow the flat outer surface region of the connecting wall 6, where the internally helically threaded hole 12 is defined, to have a width L1 that can be increased, without increasing the width of the arm body 4 itself. Because of this, it is possible to provide the rocker arm 1 that is compact in structure and lightweight while the strength required in the screw mount area 9 is sufficiently secured in the flat outer surface region of the connecting wall 6 and, yet, the width of the arm body 4 is relatively small.

Although when the rocker arm 1 embodying the present invention is in use in a loaded condition, an external force may act on the arm body 4, tending to widen the opposite side walls 5 in a lateral direction away from each other, with the outer chamfer corners 4*a* formed by the plastic deformation technique to represent the small radius of curvature R, the opposite side walls 5 can advantageously resist strongly the force tending to widen them in a lateral direction away from each other, thereby minimizing a possible deformation of the rocker arm 1 as a whole.

It is to be noted that since the width L1 of the flat outer surface region in the connecting wall 6 is increased as a result of the use of the plastic deformation technique, this can advantageously be accomplished in a short time as compared with that achieved with any known mechanical working. Thus, this additional plastic deforming step taken after the press working step of producing the arm body of a generally inverted U-sectioned configuration would not result in an undue reduction in productivity.

The width L1 of the flat outer surface region as shown in FIG. 2A may be chosen to be about equal to the outer diameter of the lock nut 13. The use of the width L1 about equal to the outer diameter of the lock nut 13 is effective and advantageous in that the lock nut 13 can be assuredly fastened firmly and, also, in that the width of the arm body 4 as a whole can be minimized to the extent required and, therefore, the rocker arm 1 compact in structure and lightweight can be manufactured.

Figure 5:
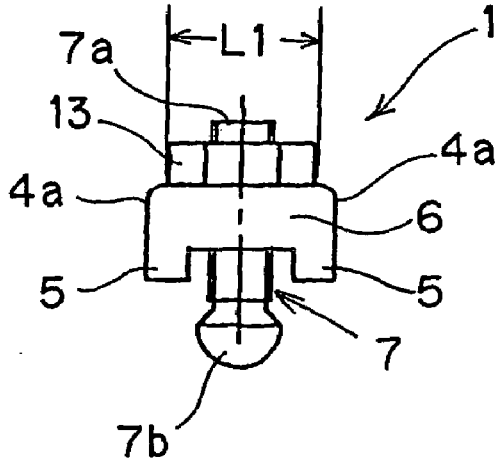
FIG. 5 is an end view of the rocker arm according to a second preferred embodiment of the present invention.
Figure 6A:
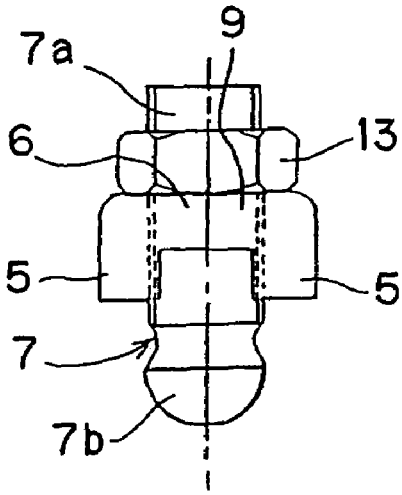
FIG. 6A is an end view of the rocker arm according to a third preferred embodiment of the present invention.
Figure 6B:
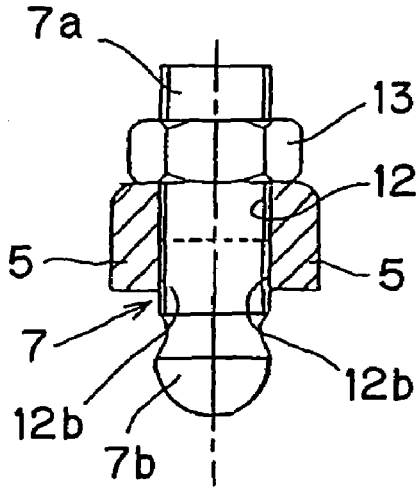
FIG. 6B is a transverse sectional view of a portion of the arm body of the rocker arm of FIG. 6A, showing the manner in which a pivot member is supported.

FIG. 5 illustrates a second preferred embodiment of the present invention. This second embodiment is substantially similar to the first embodiment shown in and described with reference to FIGS. 1 to 4B, except that in the second embodiment the connecting wall 6 has a wall thickness greater than that of other portions of the arm body 4. Other structural features of the rocker arm 1 according to the embodiment of FIG. 5 are similar to those shown in and described in connection with the first embodiment and, therefore, they are not reiterated for the sake of brevity.

The use of the connecting wall 6 of an increased wall thickness as compared with that of any other portions of the arm body 4 is advantageous in that even though the width of the arm body 4 is further reduced, the required strength can be secured in the screw mount area 9 as a pivot area and, therefore, it is possible to provide the rocker arm 1 that is compact in structure and lightweight.

Figure 7A:
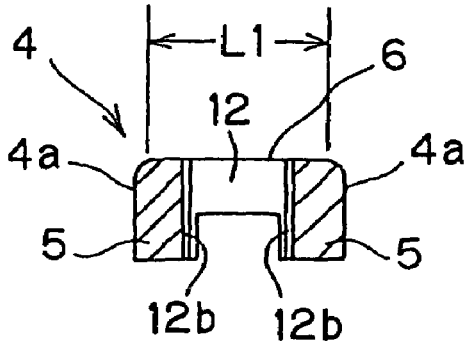
FIG. 7A is a transverse sectional view of a portion of the arm body in which a threaded hole is defined.
Figure 7B:
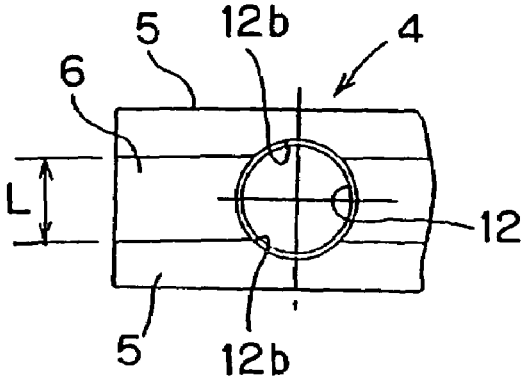
FIG. 7B is a bottom plan view of that portion of the arm body shown in FIG. 7A.

With particular reference to FIGS. 6A to 7B, a third preferred embodiment of the present invention will now be described. This third embodiment is substantially similar to the first embodiment shown in and described with reference to FIGS. 1 to 4B, except that a portion of each of mutually confronting inner surfaces of the opposite side walls 5 is formed with a helical thread 12*b* while, as shown in FIG. 7B, the mutually confronting inner surfaces of the respective opposite side walls 5 are spaced at least those portions thereof a distance L that is smaller than the bore size of the threaded hole 12 defined in the screw mount area 9 of the connecting wall 6.

The helical threads 12*b* each defined in that portion of the inner surface of each of the side walls 5 occupy a respective portion of a cylindrical extension of the internally helically threaded hole 12. Each thread 12*b* is made up of a plurality of screw teeth extending at the same helix as that of teeth of the internally helically threaded hole 12, so that when the adjustment screw 7 is inserted into the threaded hole 12, the externally helically threaded screw shank 7*a* of the adjustment screw 7 can be threadingly engaged with not only the teeth of the threaded hole 12, but also the teeth of the helical threads 12*b* in the side walls 5. Thus, the helical threads 12*b* so defined in the side walls 5 do in essence form respective part of the cylindrical extension of the internally helically threaded hole 12 in the connecting wall 6. Other structural features of the rocker arm 1 according to the embodiment of FIGS. 6A to 7B are similar to those shown in and described in connection with the first embodiment and, therefore, they are not reiterated for the sake of brevity.

According to the third embodiment shown in and described with reference to FIGS. 6A to 7B, in which the helical threads 12*b* are formed in the side walls 5 as respective parts of the cylindrical extension of the threaded hole 12 in the connecting wall 6, the screw shank 7*a* of the adjustment screw 7 can be threadingly engaged with not only the teeth of the threaded hole 12, but also the teeth of the helical threads 12*b* in the side walls 5. Thus, those portions of the mutually confronting inner surfaces of the opposite side walls 5 can also be utilized as respective parts of the threaded hole 12. Accordingly, not only can a threading strength be secured, but also the width L1 of the flat outer surface region of the arm body 4 can further be reduced, thereby facilitating reduction in size and weight of the rocker arm 1 as a whole.

Figure 8:
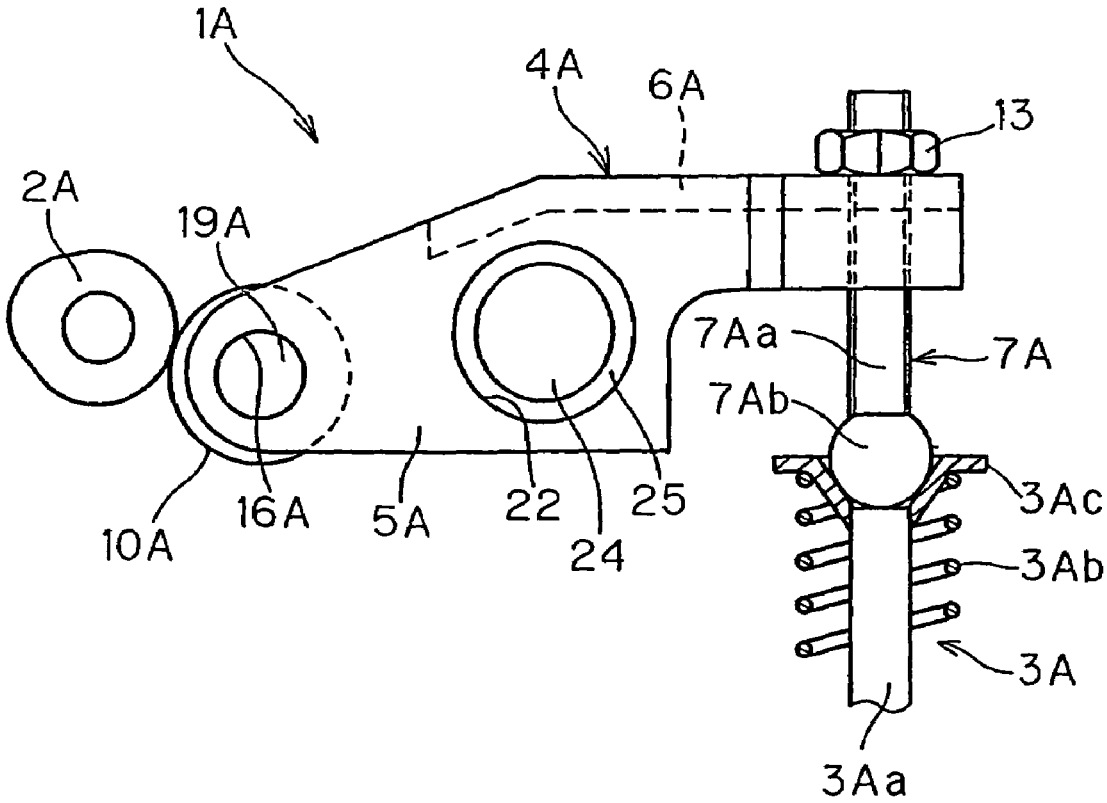
FIG. 8 is a schematic side view of the rocker arm according to a fourth preferred embodiment of the present invention.
Figure 9A:
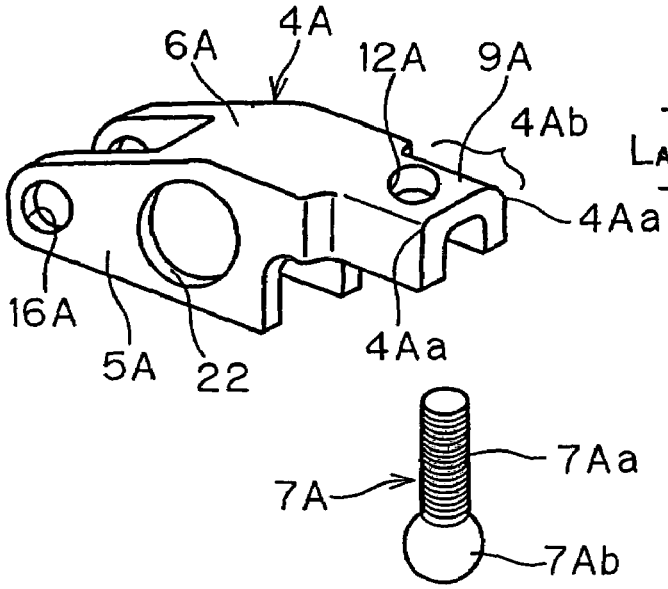
FIG. 9A is a perspective view showing the relation between the arm body of the rocker arm shown in FIG. 8 and a valve drive member.
Figure 9B:
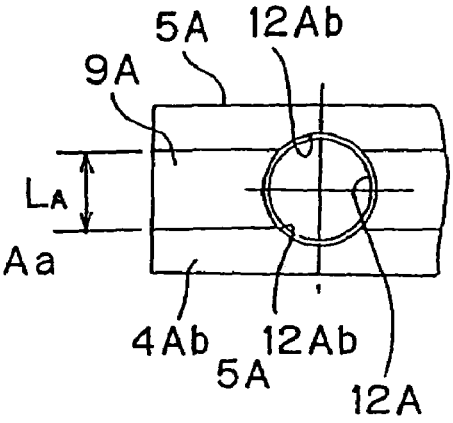
FIG. 9B is a bottom plan view of that portion of the arm body of FIG. 9A where the threaded hole is defined.

FIGS. 8 to 9B illustrates a fourth preferred embodiment of the present invention is applied to the center pivot type in which the rocker arm is rockingly supported at a generally intermediate portion thereof, in contrast to the end pivot type shown in and described with reference to FIGS. 1 to 7B. Even the rocker arm 1A of the center pivot type is mounted on an internal combustion engine and adapted to be driven by an overhead cam 2A so as to undergo a rocking motion for selectively opening and closing a valve body (not shown) on the cylinder head of the combustion engine. This valve body is rigid or integral with a lower end of a valve stem 3Aa of the valve member 3A that is movably mounted on the engine cylinder head. The rocker arm 1A includes a generally elongated arm body 4A prepared from a metallic plate material by the use of any known press working technique. However, in contrast to the end pivot type in which the adjustment screw 7 serves as a pivot member, an adjustment screw 7A employed in the center pivot type serves as a valve drive member.

The arm body 4A is rockingly supported at a generally intermediate portion thereof by means of a support axle 24 and is provided at one of its opposite ends with the adjustment screw 7A serving as a valve drive member and at the other of the opposite ends with a cam follower roller 10A engageable with the overhead cam 2. The adjustment screw 7A includes an externally helically threaded screw shank 7Aa having one end formed with a valve drive element 7Ab which is spherical. An upper end of the valve stem 3Aa is provided with a generally dish-shaped seat member 3Ac for receiving the valve drive element 7Ab of the adjustment screw 7A. Even this valve member 3A is normally biased upwardly by a compression spring 3Ab mounted around the valve stem 3Aa.

As best shown in FIGS. 9A and 9B, the arm body 4A prepared from a single metallic plate material by the use of any known press working technique is made up of opposite side walls 5A and a connecting wall 6A bridging between the opposite side walls 5A, all assembled together to render the arm body 4 to represent a generally inverted U-shaped section over the substantially entire length of the arm body 4A. As shown in FIG. 8, the connecting wall 6A assumes an upper position with respect to the engine cylinder head and is positioned on one side opposite to the valve member 3A.

The arm body 4A has a side profile which is substantially straight, but which may be angled if so desired. The connecting wall 6A extends over the substantially entire length of the rocker arm 1A but has one end portion depleted to define a roller window where the cam follower roller 10 is situated and is partially exposed for rolling contact with the overhead cam 2A. The pivot fulcrum about which the rocker arm 1A undergoes a rocking motion is defined by a support shaft 24. This support shaft 24 is engaged through bushings 25 in bearing holes 22 which are respectively defined in generally intermediate portions of the opposite side walls 5A.

As shown in FIG. 8, the roller 10A is rotatably mounted on a support axle 19A that is rigidly supported at its opposite ends by the opposite side walls 5A. The support axle 19A has its opposite ends firmly received in corresponding bearing holes 16A defined in the opposite side walls 5A. It is to be noted that the specific structure of the roller 10A in the embodiment of the center pivot type may be such as shown in and described with reference to any one of FIGS. 3A to 3C.

The end portion of the connecting wall 6A remote from the roller 10A and defining a screw mount area 9A is formed with an internally helically threaded hole 12A for threadingly receiving the adjustment screw 7A as will subsequently be detailed. The adjustment screw 7A having the externally helically threaded screw shank 7Aa is mounted on that end portion of the connecting wall 6A with the screw shank 7Aa threadingly inserted through the threaded hole 12A so that an upper end portion of the screw shank 7Aa can protrude a distance outwardly above the connecting wall 6A. The lock nut 13 is threaded onto the upper end portion of the screw shank 7Aa until it is brought into in tight contact with the connecting wall 6A to thereby lock the adjustment screw 7A in position relative to the connecting wall 6A and, hence, the arm body 4A in a manner similar to that hereinbefore described.

As clearly shown in FIGS. 9A and 9B, the end portion of the arm body 4A, where the threaded hole 12A is situated, is narrowed in width, forming a narrowed side portion 4Ab so that corresponding portions of the mutually confronting inner surfaces of the opposite side walls 5A may be spaced from each other a distance $L_A$ the mutually confronting inner surfaces of the narrowed side wall portion 2Ab are formed with respective helical threads 12Ab which occupy respective opposite parts of a cylindrical extension of the internally helically threaded hole 12A and which are each made up of a plurality of screw teeth extending at the same helix as that of teeth of the internally helically threaded hole 12A. Accordingly, when the adjustment screw 7A is inserted into the threaded hole 12A, the externally helically threaded screw shank 7Aa of the adjustment screw 7A can be threadingly engaged with not only the teeth of the threaded hole 12A, but also the teeth of the helical threads 12Ab in the side walls 5A.

It is, however, to be noted that the narrowed side wall portion 4Ab where the threaded hole 12A and helical threads 12Ab are defined is not always essential and the arm body 4A may have the same width over the substantially entire length thereof. It is also to be noted that the helical threads 12Ab forming respective parts of the cylindrical extension of the threaded hole 12A may not be always essential and may therefore be dispensed with.

Even in this rocker arm 1A, since each of outer corners formed by a bending work between an outer surface of the connecting wall 6A and an outer surface of the respective side walls 5A is plastically deformed to have a small radius of curvature, the resulting plastically deformed portions, that is, the outer chamfered corners 4Aa having the uniquely designed radius of curvature R effectively allow the flat outer surface region of the connecting wall 6, where the internally helically threaded hole 12A is defined, to have a width that can be increased, without increasing the width of the arm body 4A itself. Because of this, it is possible to provide the rocker arm 1 that is compact in structure and lightweight while the strength required in the screw mount area 9A is sufficiently secured and, yet, the width of the arm body 4A can have a relatively small value.

Other structural features of and advantages brought about by the rocker arm 1A according to the embodiment of FIG. 8 to FIG. 9B are similar to those shown in and described in connection with the first embodiment and, therefore, they are not reiterated for the sake of brevity.

Figure 10:
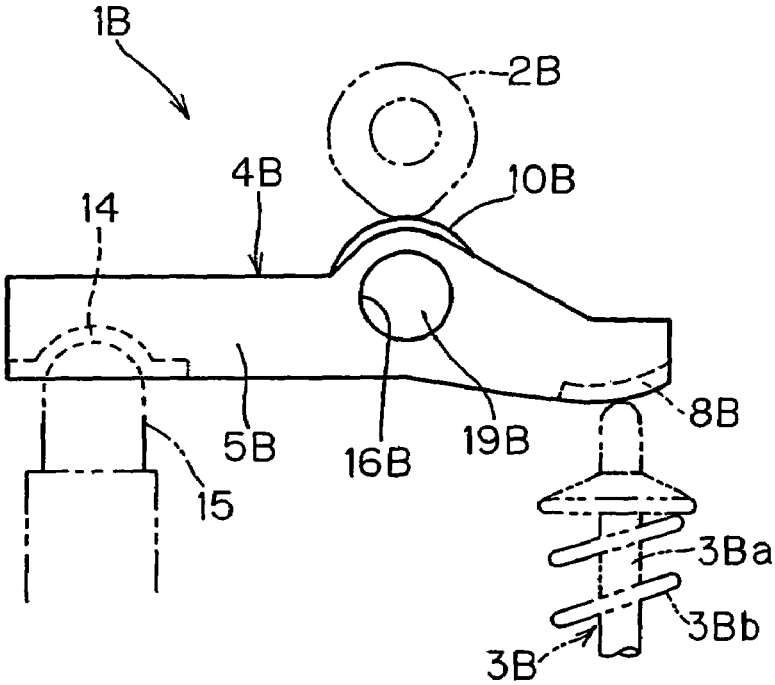
FIG. 10 is a schematic side view of the rocker arm according to a fifth preferred embodiment of the present invention.
Figure 11:
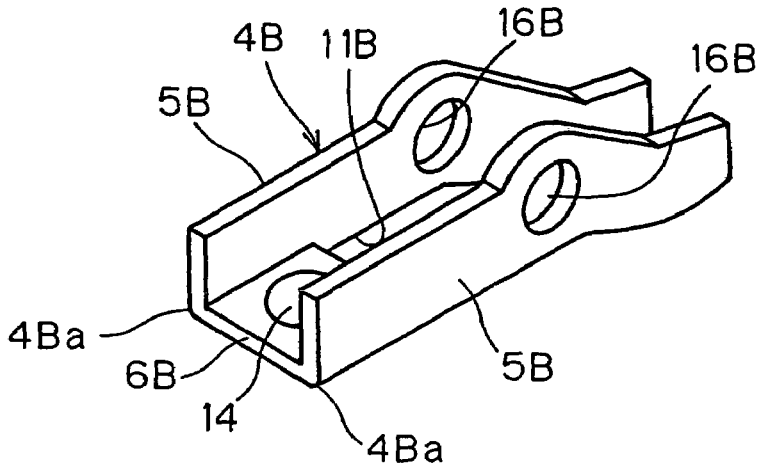
FIG. 11 is a schematic perspective view of the arm body of the rocker arm shown in FIG. 10.
Figure 12A:
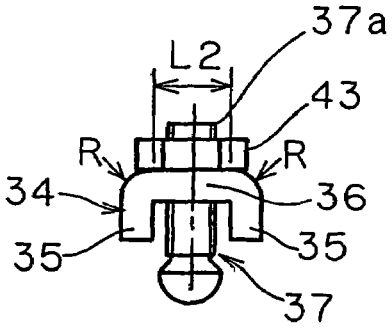
Fig. 12A Prior Art
FIG. 12A is an end view of the arm body of the prior art rocker arm.
Figure 12B:
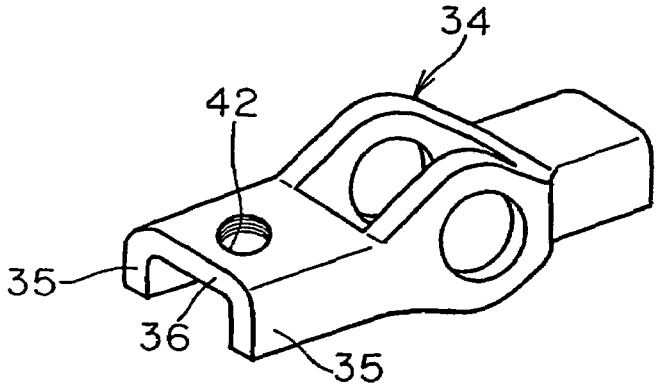
Fig. 12B Prior Art
FIG. 12B is a perspective view of the arm body of the rocker arm shown in FIG. 12A.
Figure 13:
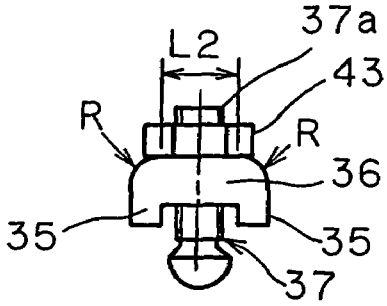
Fig. 13 Prior Art
FIG. 13 is an end view of the arm body of another prior art rocker arm.

Referring now to FIGS. 10 and 11, the rocker arm according to a fifth preferred embodiment of the present invention will be described as applied to the end pivot type. Even this rocker arm 1B is mounted on an internal combustion engine and adapted to be driven by an overhead cam 2B so as to undergo a rocking motion for selectively opening and closing a valve body (not shown) on the cylinder head of the combustion engine. This valve body is rigid or integral with a lower end of a valve stem 3Ba of the valve member 3B that is movably mounted on the engine cylinder head. The rocker arm 1B includes a generally elongated arm body 4B prepared from a metallic plate material by the use of any known press working technique. The arm body 4B has one end defining a pivot abutment area 14 that is upwardly concaved as viewed in FIG. 10 and is rockingly supported by a pivot fulcrum member 15. Specifically, the pivot fulcrum member 15 has an upper end rounded substantially semispherically and supports the arm body 4B with the rounded upper end slidingly engaged in that pivot abutment area 14.

The other end of the arm body 4B is provided with a valve drive area 8B engageable with an upper end of the valve stem 3Ba of a valve member 3B. The valve member 3 is movable up and down, but is normally biased upwardly, as viewed in FIG. 10, by a compression spring 3Bb.

The roller 10B is rotatably mounted on a support axle 19B that has its opposite ends firmly received in corresponding bearing holes 16B defined in the opposite side walls 5B. It is to be noted that the specific structure of the roller 10B in this embodiment may be such as shown in and described with reference to any one of FIGS. 3A to 3C.

The arm body 4B prepared from the single plate material such as a steel plate by the use of the press working technique is made up of opposite side walls 5B and a connecting wall 6B bridging between the opposite side walls 5B, so as to represent a generally U-shaped section over the substantially entire length of the arm body 4B. The connecting wall 6B assumes a lower position with respect to the engine cylinder head and is positioned on the same side as the valve member 3B. The arm body 4B has a side profile which is substantially straight, but which may be angled.

The connecting wall 6B extends over the substantially entire length of the arm body 4B but has its intermediate portion depleted to define a roller window 11B from which the roller 10 may be partially exposed. One end portion of the connecting wall 6 adjacent the valve member 3 defines the valve drive area 8B engageable with the upper end of the valve stem 3*a* while the opposite end portion thereof defines the pivot abutment area 14 for receiving the pivot fulcrum member 15.

Even in this rocker arm 1B, each of those outer side corners delimited between an outer surface of the connecting wall 6B and an outer surface of the respective side walls 5B formed by bending is deformed to represent a plastically deformed portion which is so formed by means of a plastic deformation technique that the respective outer chamfered corner, as defined hereinbefore, can represent a small radius of curvature R (See FIGS. 4A and 4B). This plastically deformed portion 4Ba is similar to and is formed in a manner similar to that shown and discussed in connection with the first embodiment of the present invention. Accordingly, the radius of curvature of each outer chamfered corner 4Ba can have a value smaller than the wall thickness of the arm body 4B, specifically a value equal to or smaller than 70% of the wall thickness of the arm body 4B.

The presence of the plastically deformed portion, that is, the outer chamfered corner 4Ba having the uniquely designed radius of curvature R does effectively allow the flat outer surface region of the connecting wall 6 adjacent the pivot abutment area 14 to have a width that can be increased without increasing the width of the arm body 4B itself. In other words, because of the uniquely designed radius of curvature R, the width of the outer flat surface region is increased without having to increase the thickness of the plate material from which the arm body 4B is fabricated and without having to change the total width of the connecting wall 6B. Because of this, it is possible to provide the rocker arm 1B that is compact in structure and lightweight while the strength required in the pivot abutment area 14 is sufficiently secured and, yet, the width of the arm body 4B can have a relatively small value. arm body 4B can have a relatively small value.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

What is claimed is:

1. A rocker arm capable of being driven by a cam for selectively opening and closing a valve mounted on a cylinder head of a combustion engine, the rocker arm comprising:

a generally elongated arm body having first and second ends opposite to each other and prepared by bending a single plate material to represent a generally U-shaped section including opposite side walls and a connecting wall bridging between the opposite side walls, an end portion of the connecting wall adjacent the second end of the arm body being formed with a pivot abutment area, to which a free end of a pivot support member is engaged;

a cam follower roller rotatably mounted on a portion of the arm body generally intermediate between the first and second ends thereof for engagement with the cam; and a valve drive element mounted on the first end of the arm body for driving the valve;

wherein an outer chamfered corner delimited between an outer surface of the connecting wall and an outer surface of each of the opposite side walls and formed by bending is deformed to represent a plastically deformed portion so formed by means of a plastic deformation technique that the outer chamfered corner represents a small radius of curvature, and the radius of curvature of the outer chamfered corner delimited between the outer surface of the connecting wall and the outer surface of each of the opposite side walls is smaller than 70% of the wall thickness of the arm body.

2. A cam driven rocker arm to selectively open and close a valve mounted on a cylinder head of a combustion engine, the rocker arm comprising:

an arm body prepared by bending a single plate material to represent a generally U-shaped section, the arm body having first and second opposing ends opposite side walls, a first connecting wall bridging between the opposite side walls at the first end, the first connecting wall comprising a valve drive element to drive the valve, and a second connecting wall bridging between the opposite side walls at the second end, the second connecting wall comprising a pivot abutment area, to which a free end of a pivot support member is engaged;

a cam follower roller rotatably mounted on a portion of the arm body generally intermediate between the first and second ends thereof to engage a cam, wherein an outer chamfered corner formed by bending and delimited between an outer surface of the respective connecting walls and an outer surface of each of the opposite side walls is deformed using a plastic deformation technique so that the outer chamfered corner represents a radius of curvature smaller than 70% of the wall thickness of the arm body.

* * * * *